US005365824A

United States Patent [19]

Hoshino

[11] Patent Number: 5,365,824

[45] Date of Patent: Nov. 22, 1994

[54] SPRING ADJUSTMENT MECHANISM FOR DRUM PEDAL BEATER

[75] Inventor: Yoshiki Hoshino, Aichi, Japan

[73] Assignee: Hoshino Gakki Co., Ltd., Japan

[21] Appl. No.: 138,130

[22] Filed: Oct. 15, 1993

[30] Foreign Application Priority Data

Mar. 19, 1993 [JP] Japan ..... 5-018601

[51] Int. Cl.[5] ..... G10D 13/02

[52] U.S. Cl. ..... 84/422.1

[58] Field of Search ..... 84/422.1, 422.2, 422.3

[56] References Cited

U.S. PATENT DOCUMENTS

| | | | |
|---|---|---|---|
| 3,426,640 | 2/1969 | Slingerland, Jr. | 84/422.1 |
| 4,262,576 | 4/1981 | Gorsky et al. | 84/422.1 |
| 4,756,224 | 7/1988 | Lombardi | 84/422.1 |
| 4,890,532 | 1/1990 | Carlson | 84/422.1 |

*Primary Examiner*—Michael L. Gellner
*Assistant Examiner*—Cassandra C. Spyrou
*Attorney, Agent, or Firm*—Ostrolenk, Faber, Gerb & Soffen

[57] ABSTRACT

A drum beater pedal having a support which supports a pivotable beater shaft. A beater on the shaft swingable toward and away from a drum head as the shaft is rotated. A pedal connected with the beater shaft for rotating the beater shaft to swing the beater. A cam on and rotatable with the shaft. A spring hanger supported on the cam by a bearing which permits free rotation of the spring hanger with respect to the cam. A spring extending from the spring hanger to a spring tension adjustment screw. An installation part secured to the support. The adjustment screw extending through a hole in the installation part and the screw and the hole being profiled so that the screw is prevented from rotating with respect to the installation part. An adjustment screw height adjustment nut below the installation part. An adjustment nut rotation blocking protuberant part projecting into a window in the installation part. A lock nut above the installation part tightenable on the screw against the installation part for drawing the protuberant part of the adjustment nut to the installation part and locking the adjustment nut from rotating, whereby the spring tension is not undesirably adjusted due to either adjustment screw rotation or adjustment nut rotation.

12 Claims, 11 Drawing Sheets

SPRING ADJUSTMENT MECHANISM FOR DRUM PEDAL BEATER

BACKGROUND OF THE INVENTION

This invention relates to a spring adjustment mechanism for a beater of a drum pedal enabling free adjustment of the beater amplitude and the pedal height and particularly to assuring that the tension on the return spring for the drum beater stays at a set level.

In a conventional beater mechanism for a bass drum, shown for example in FIGS. 9 and 10, supports 92 are erected at both sides of the base 91 of a drum pedal device 90. A beater rotary shaft 94 is freely rotatably supported at the tops of the supports 92 through respective ball bearings 93.

There is a beater 110 approximately at the center of the rotary shaft 94, and next to the beater is an operating member 120, which is in the shape of a wheel or sprocket. Both rotate integrally with the beater 110. The beater head 115 is fixed to the beater 110 by means of stopping screws 116.

The operating member 120 comprises a sprocket or a partial sprocket, with a chain 121 having an end that is fixed at the operating member 120 and is wound on its outer periphery. The other end of the chain 121 is linked to the tip of a foot pedal 95. As the foot pedal 95 is stepped on, as indicated by an arrow mark A in FIG. 9, the chain 121 is pulled down. This rotates the operating member 120 which in turn rotates the beater, thereby causing the beater head 115 to beat the drum head surface D.

A cam 100 is fixed at the end of the rotary shaft 94 by a stopper screw 101, as shown in FIG. 11. The cam 100 has the approximate shape of a fan, as shown in FIG. 9. At that position which corresponds to the pivot of the fan, there is a shaft receiving hole 102 through which the rotary shaft 94 is installed. A plurality of roller installation holes 103 may be provided spaced away from the hole 102 at various positions over the cam.

A roller installation bolt 104 is screwed into one of the roller installation holes 103 which is selected dependent upon the initial pivot orientation of the cam 100. A hanging ring 106 is suspended from a roller 105 that is installed on the roller installation bolt 104. The top end of a tension spring 107 is engaged at the bottom tip of the hanging ring 106. The bottom end of the spring 107 is engaged with a lower bracket 109 at the outside of the support 92. The spring 107 is tensioned to normally return the beater 115 to its original position automatically. An adjustment bolt 108 adjusts the tension of the spring 107. A clamp 130 holds the beater mechanism to the drum hoop.

Adjustment of the tension of the spring 107 in the above conventional device is done with an adjustment device 140 which is provided at the bottom of the spring 107. The adjustment device 140 comprises an adjustment screw 141, an adjustment nut 142 threaded on the screw below the bracket 109 and a lock nut 143 threaded on the screw above the bracket 109. The adjustment screw 141 is inserted through an adjustment screw insertion hole 144 in the lower bracket 109 and is linked to the lower end of the spring 107. The screw is then secured from below the lower bracket 109 by the adjusting nut 142 and is locked in the selected adjusted position by tightening the lock nut 143 against the bracket 109. A metal washer 145 seats the lock nut 143 firmly.

For adjusting the tension of the spring 107, the lock nut 143 is loosened, and the adjusting nut 142 is rotated until the spring 107 has a desired spring tension. Then the lock nut 143 is tightened against the lower bracket 109, thereby fixing the position of the adjustment screw 141.

In the above described mechanism of the prior art, however, during rotation of the adjustment nut 142, the adjustment screw 141 may also rotate inside the installation hole 144 of the lower bracket 109, thereby changing the direction of the screw. This also changes the direction of the spring 107 causing a delicate change in the resistance, or load or tension of the spring due to its being twisted.

In addition, it is believed that the resistance by the adjustment screw serves as one cause of early weakening of the tensile strength of the spring 107. During use of the drum pedal, further, the adjustment nut 142 may become loosened so that the adjustment screw 141 becomes shaky, with a possibility that the set position of the desired spring tension may change.

Moreover, there is resistance to adjustment of the tension in the spring due to the friction between the roller 105 and the installation part 104. This resistance also delicately affects the amplitude of the beater.

SUMMARY OF THE INVENTION

An object of the invention is to overcome the aforementioned problems of the conventional device.

Another object of the invention is to be able to selectively adjust the tension on the return spring for the drum beater without twisting the spring.

A further object of the invention is to inhibit loosening of the securement of the spring during use of the drum beater.

Another object of the invention is to provide a spring adjustment mechanism for a drum pedal wherein the desired amplitude of the beater can be accurately obtained without applying a resistance or a load to the spring in connection with adjustment of the tension of the spring.

The invention relates to a spring adjustment mechanism for a drum pedal. The drum pedal includes a beater rotary shaft which is journaled at the top of a support and is rotated by an operating member and on which a beater member is installed. The beater rotary shaft operating member is linked to a pedal.

A cam is provided on the beater rotary shaft. The top end of the drum beater return motion tension spring is hooked to a hanger part of the cam through a hanger part or ring, and the bottom end of the spring is hooked to an adjustment screw. The adjustment screw is received in a hole in an installation part held fixed to the beater support. The screw is adjusted up or down freely with respect to the installation part by means of an adjustment nut screwed onto the screw below the installation part, while the adjustment screw is prevented from rotating by an appropriately profiled insertion hole for the screw at the installation part on the beater support. In particular, the screw has a planar side that extends in the longitudinal direction and there is an engagement part on the edge of the insertion hole in the installation part that is engaged by the planar side of the screw.

The adjustment nut and the installation part include cooperating means that engage to prevent rotation of the adjustment nut with respect to the screw and which are disengageable to permit such rotation. Once the position of the adjustment nut has been set along the screw, a lock nut is tightened along the screw to the top of the installation part which engages the cooperating means.

The installation part, screw, adjustment nut and lock nut cooperate to prevent rotation of both the adjustment nut and the screw.

The hanging part of the cam includes a freely rotatable roll bearing that permits free swiveling of the hanger part for the top end of the spring.

Other objects and features of the invention are explained below with reference to the attached drawings.

DESCRIPTION OF THE PREFERRED EMBODIMENTS

Figure 1:
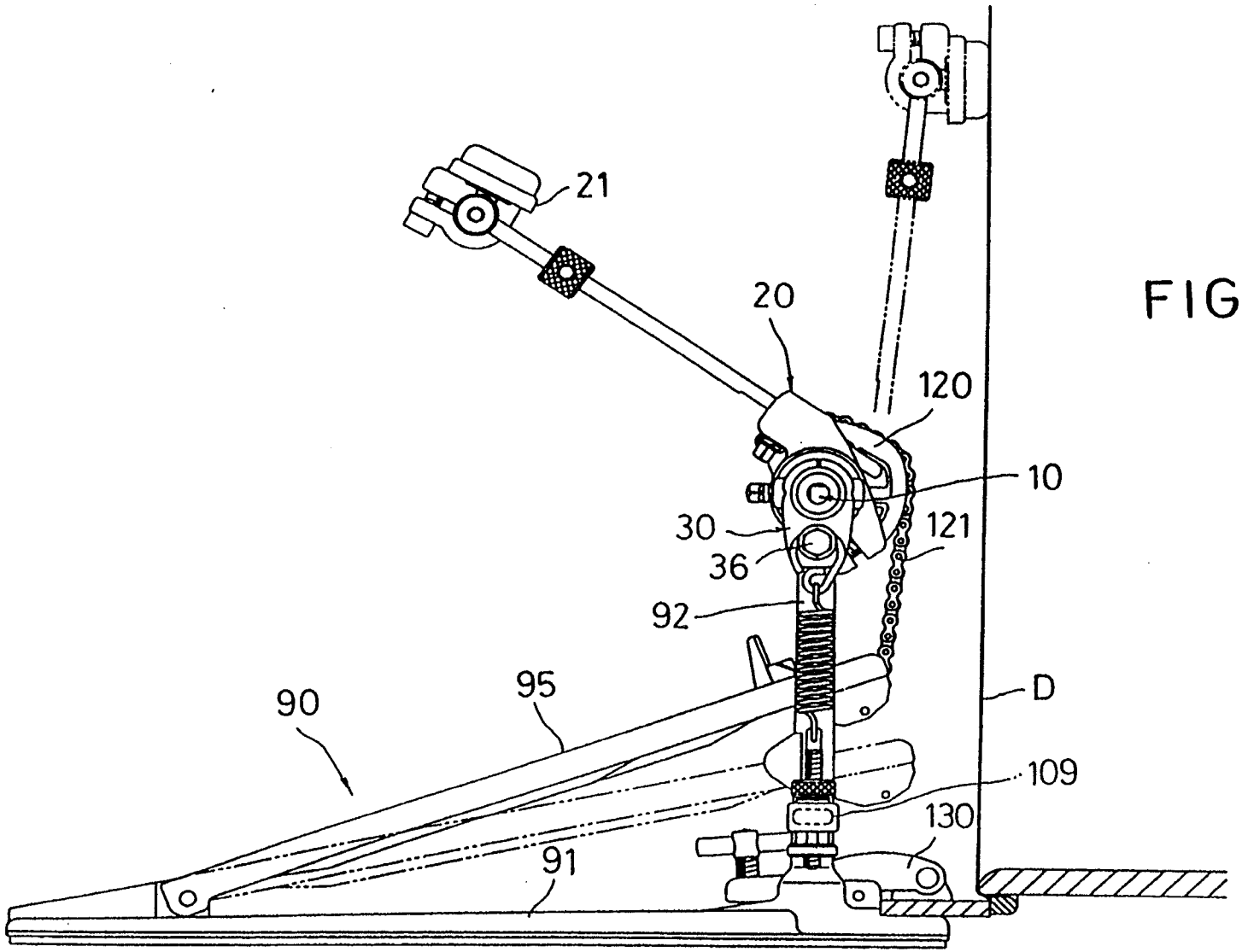
FIG. 1 is a side view of a drum pedal having a spring adjustment structure according to the invention.
Figure 2:
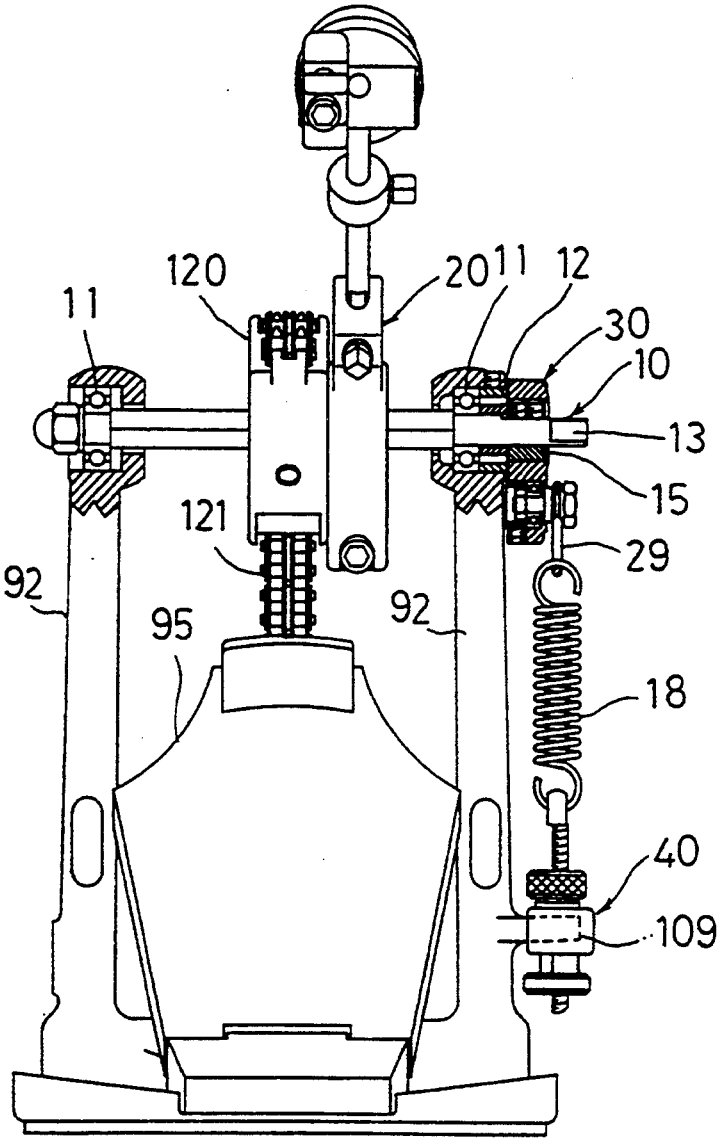
FIG. 2 is a rear view of the drum pedal partly in cross section.
Figure 9:
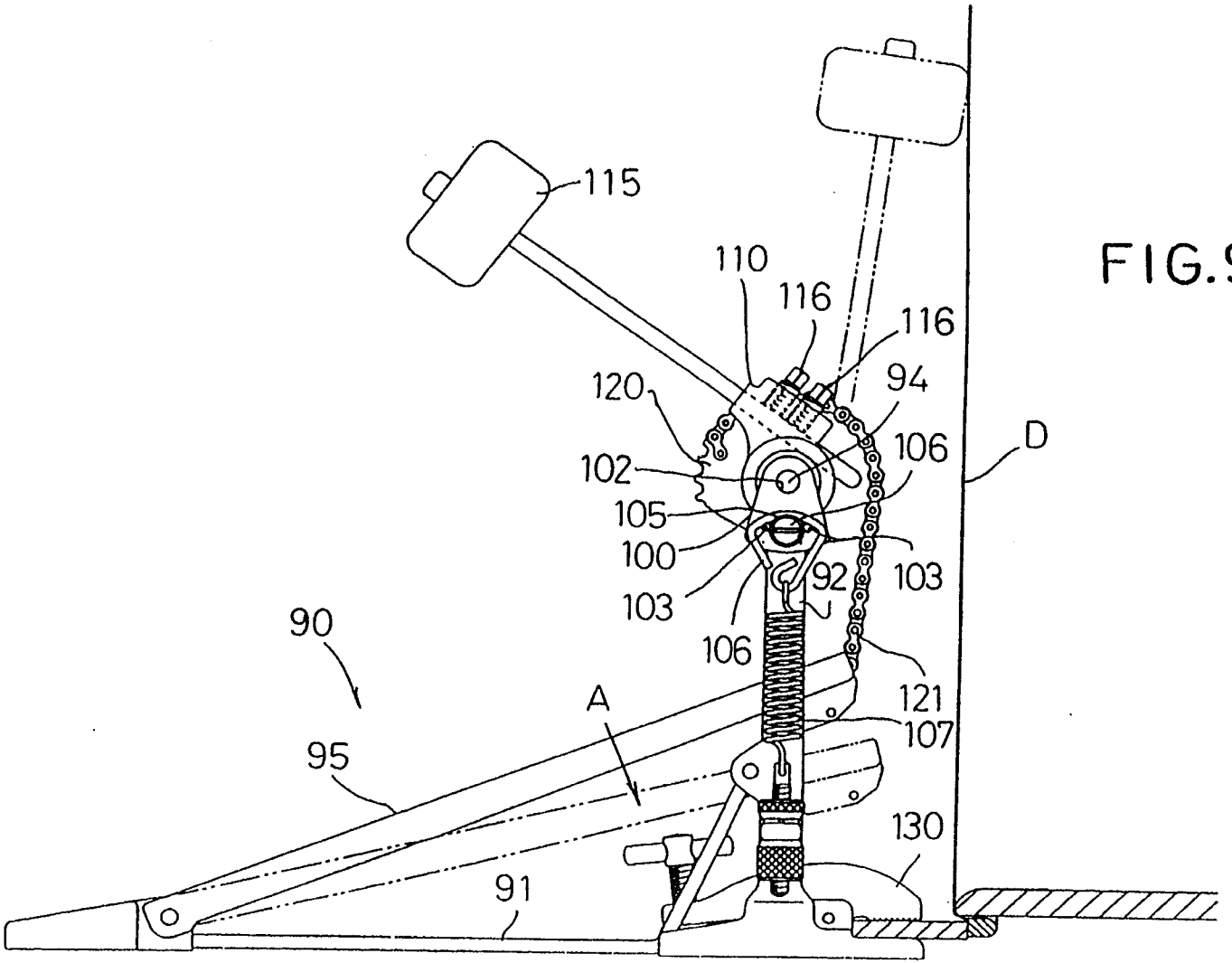
FIG. 9 is a side view of a spring adjustment mechanism for a drum pedal according to prior art.
Figure 10:
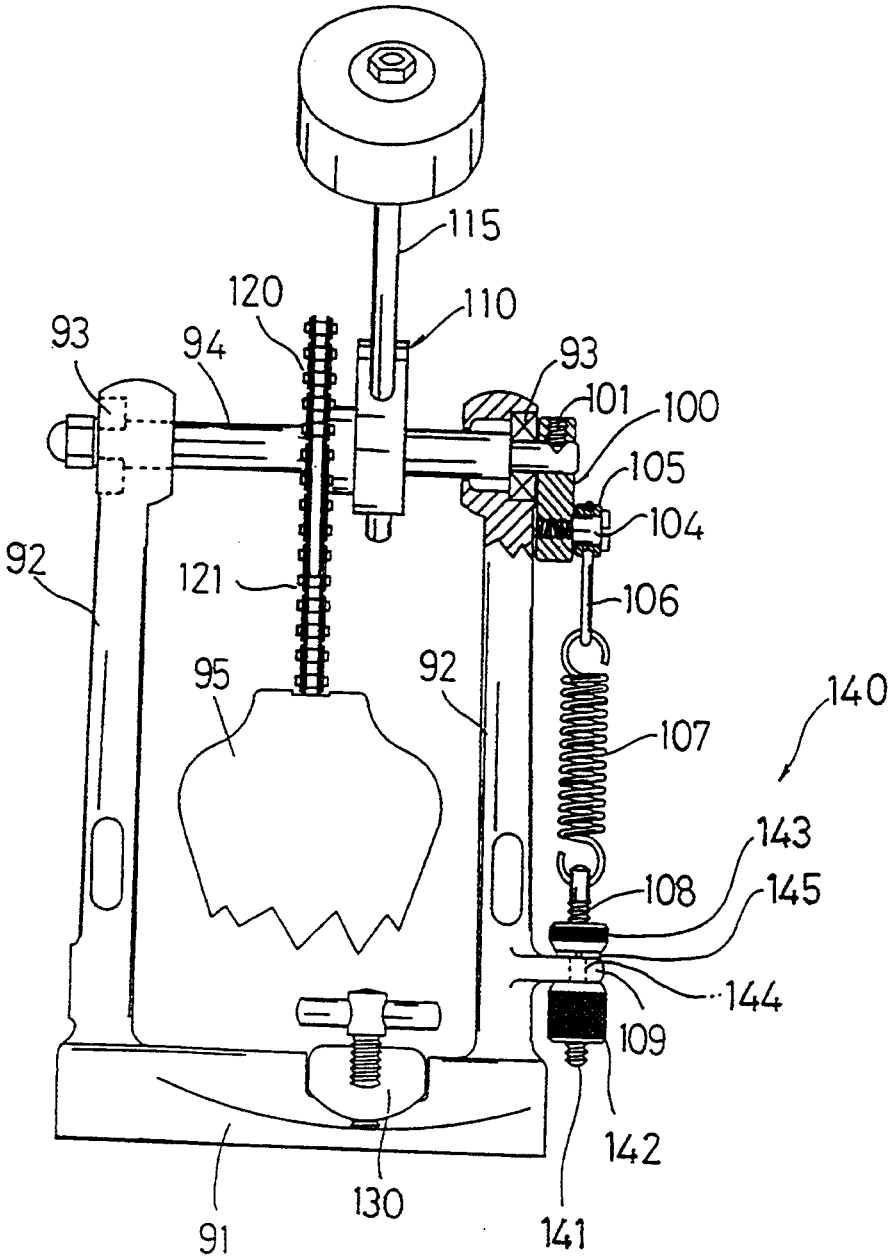
FIG. 10 is a rear view of the prior art drum pedal with a part thereof shown in cross section.
Figure 11:
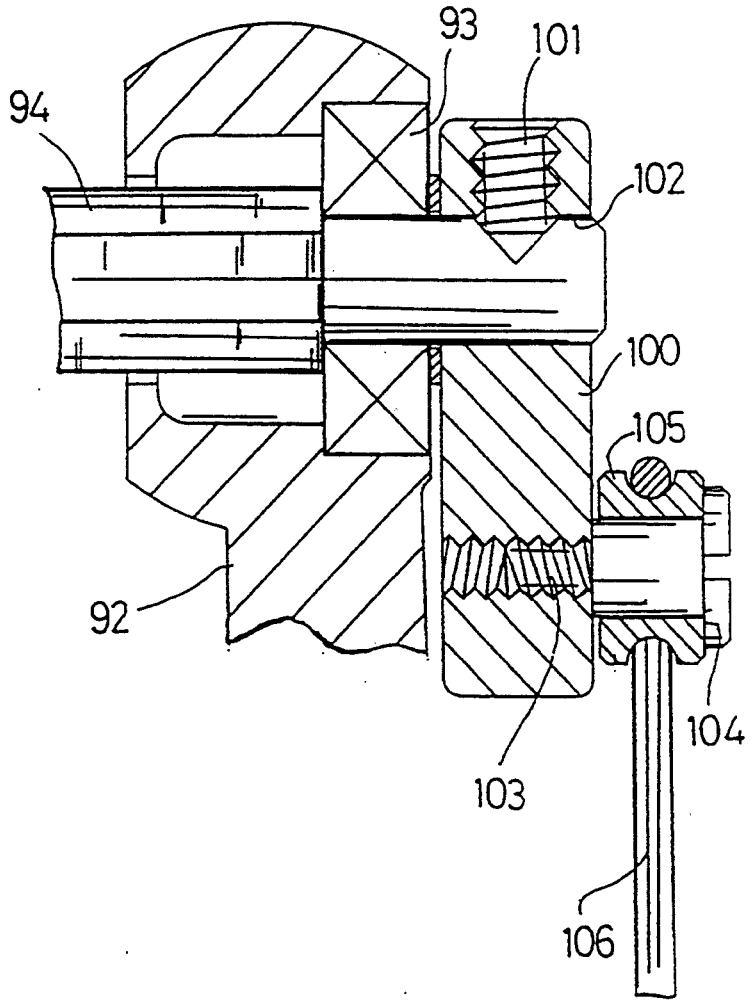
FIG. 11 is a cross section showing the essential part of the prior art drum pedal.

A spring adjustment mechanism according to the invention for a drum pedal shown in FIGS. 1 and 2 has the purposes of determining the rotary speed of the beater rotary shaft 10, the stepping on feeling on the pedal 95 and the speed of the beater 20. Reference numbers which are the same as those used in the above described prior art drum pedal of FIG. 9 indicate the same elements.

There is a horizontal beater rotary shaft 10 which is supported freely rotatably by respective bearings 11 at the tops of the supports 92 which are erected on both sides of the base 91 of the drum pedal device 90. There is a bearing holder 12 at each bearing 11. A beater 20 is installed approximately at the center of the beater rotary shaft 10. A beater head 21 is at the end of a rod of the beater 20.

Figure 3:
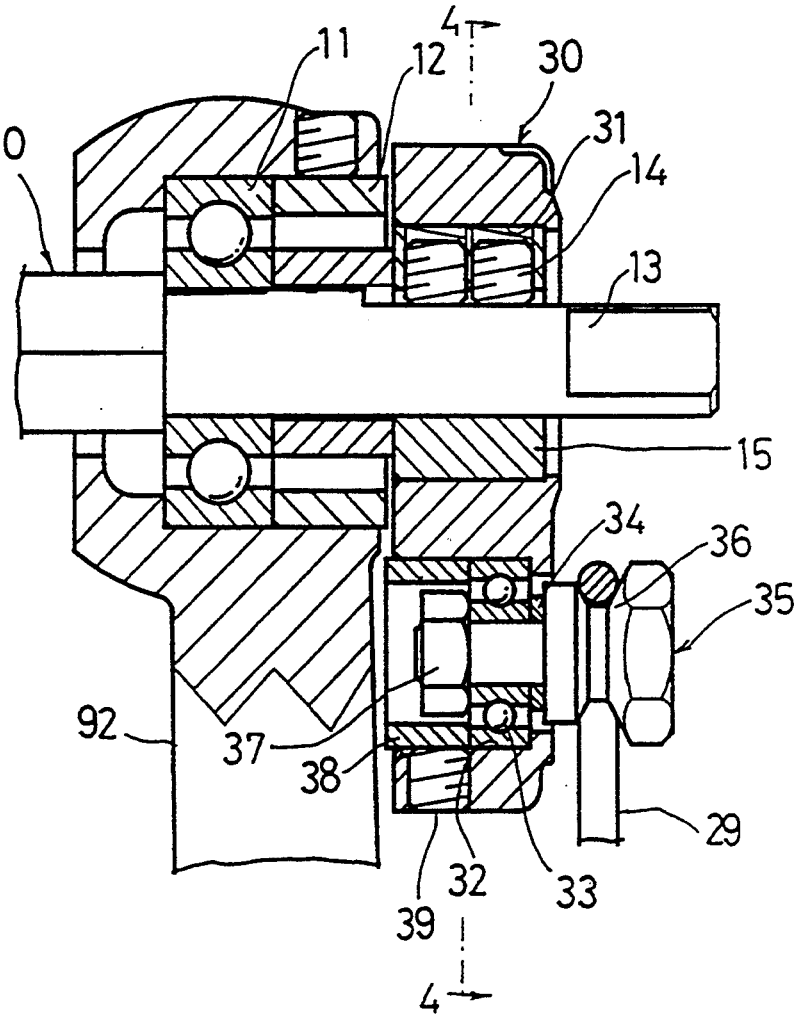
FIG. 3 is a cross section detail showing the connection between the beater rotary shaft and cam.
Figure 4:
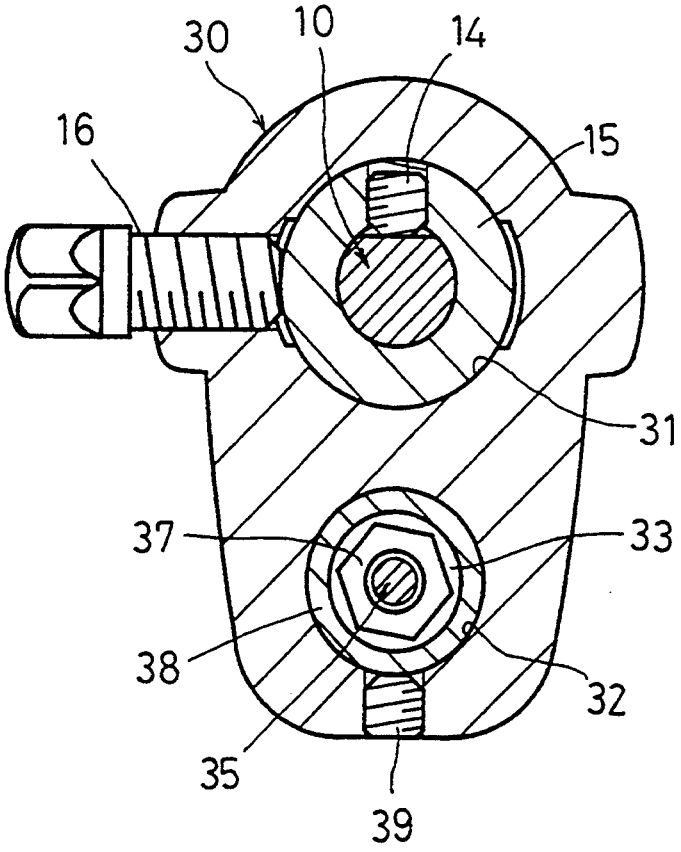
FIG. 4 is a cross section cut along line 4—4 in FIG. 3.

A cam 30 is installed on the end 13 of the beater rotary shaft 10. As shown in FIGS. 3 and 4, the cam 30 has a larger diameter axis hole 31 into which the beater rotary shaft 10 is inserted. Below the hole 31 and thus off the axis of swing of the beater, the cam has at least one larger diameter bearing installation hole 32.

The cam 30 is installed on the beater rotary shaft 10 through a cam receptacle 15 that is formed in the axis hole 31. The cam 30 is thus initially installed freely rotatably on the beater rotary shaft 10, as the cam 30 slides on the outside of the cam receptacle 15. A fixing screw 14 fixes the cam receptacle 15 to the beater rotary shaft 10. A stopper screw 16 fixes the position of the cam 30 on the beater rotary shaft 10.

Figure 7:
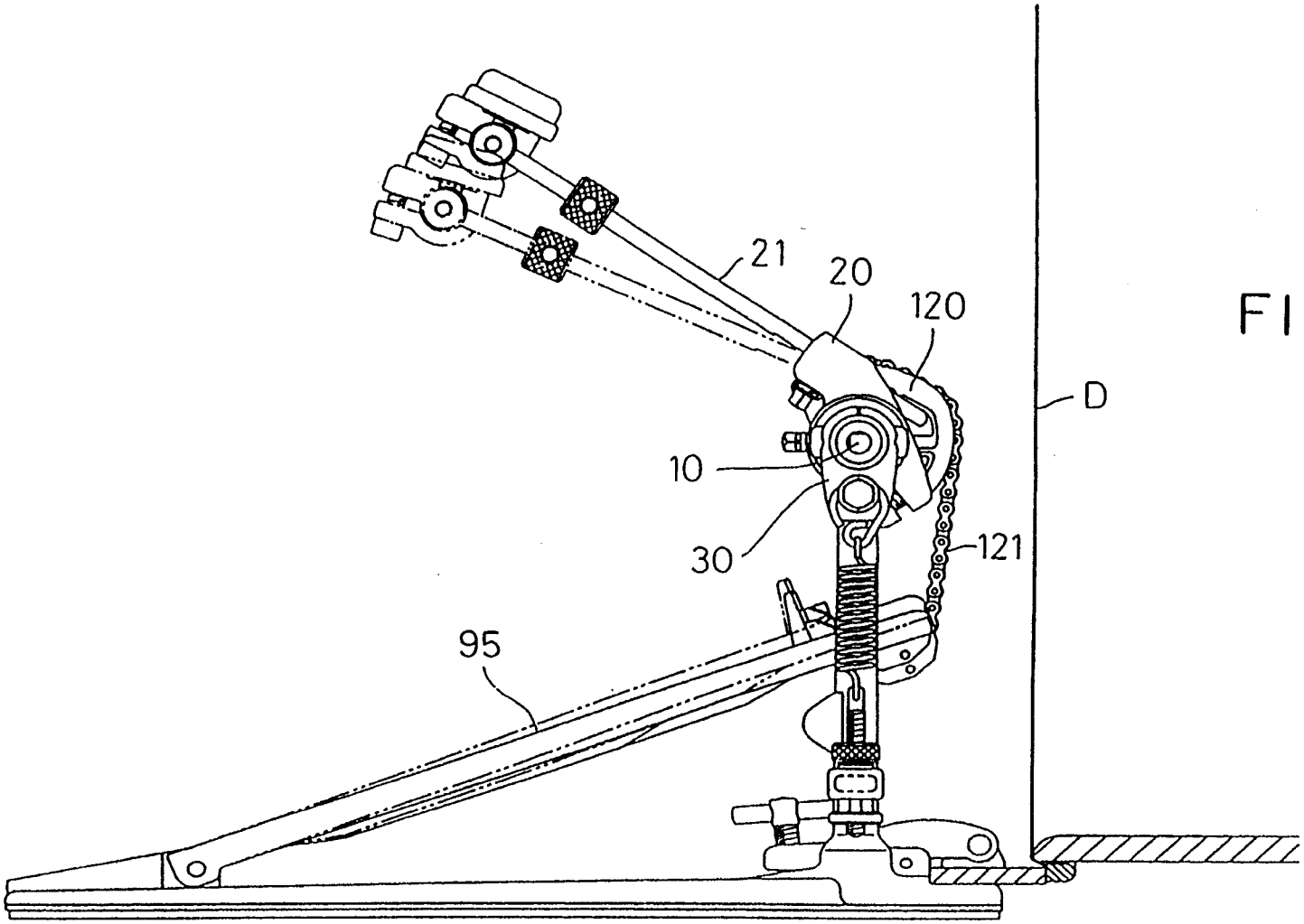
FIG. 7 is a side view showing the action of the cam which is used in the invention.
Figure 8:
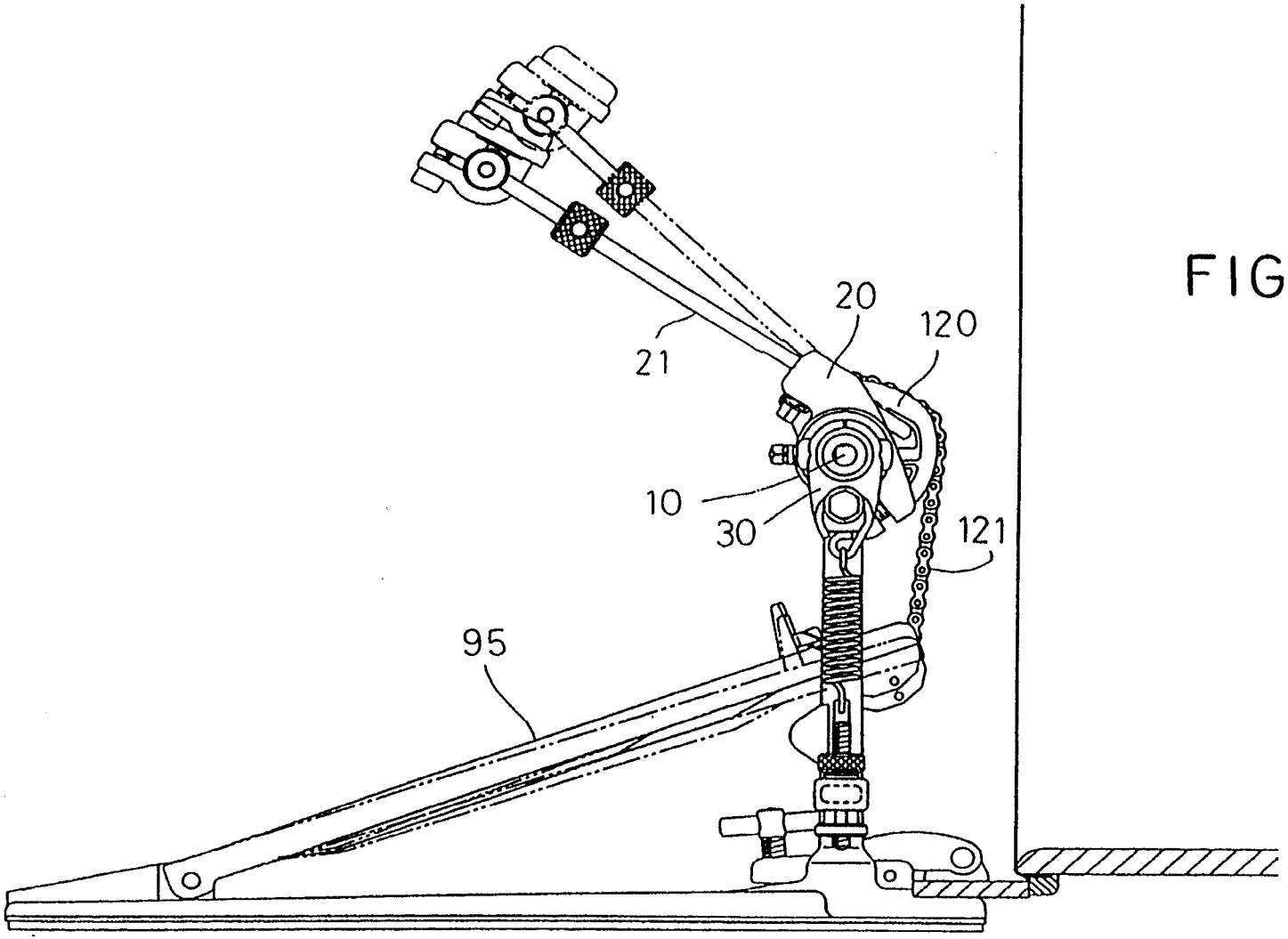
FIG. 8 is also a side view showing another example of the action of the cam.

This construction makes it possible to fix the cam 30 at a desired orientation around the beater rotary shaft 10, which fixes the orientation of the beater rotary shaft 10 for the purpose of changing the initial spacing of the beater off the drum head and of changing the initial height of the foot pedal 95, as seen with reference to FIGS. 7 and 8. Accordingly, position adjustment of the foot pedal 95 can be carried out along a continuous path without any steps, thereby meeting the delicate requirements for height adjustment of the pedal.

Supported in the bearing installation hole 32 of the cam 30 is a ball bearing 33 in which is disposed a roller 35. The roller 35 is generally bolt shaped and includes a hanger part 36 at its outer tip. The roller 35 is freely rotatably installed in the bearing installation hole 32 with the hanger part 36 outside the cam 30. There is a tightening nut 37 for the bolt shaped roller 35 for holding it inside the bearing. A metal washer is installed between the hanger part 36 and the bearing 33.

A hanging ring 29 is suspended from the hanger part 36 of the roller 35. The top end of the spring 18 is installed through the hanging ring 29. A ball bearing holder 38 is installed at the other axial side of the bearing 33. A tightening screw 39 secures the ball bearing holder 38 to the cam 30. The ball bearing 33 avoids obstructing the rotation of the roller 35, and the roller can rotate easily even when the tensile strength of the spring 18 is applied to the hanger part 36.

The other, bottom end of the spring 18 is linked to an installation part, here a lower bracket 109 at the lower part of the support 92 of the drum pedal, through an adjusting device 40 according to the invention. The spring 18 is a tension spring and as it normally seeks to return to its condition of least tension, it pulls the cam 30 to a return position, which rotates the shaft to raise the beater head away from the drum head.

The tension of the spring 18 is increased or decreased by the adjusting device 40, to establish the performer's desired foot feelings at the time when the foot pedal 95 is stepped on and to adjust the return speed of the beater 21.

Figure 5:
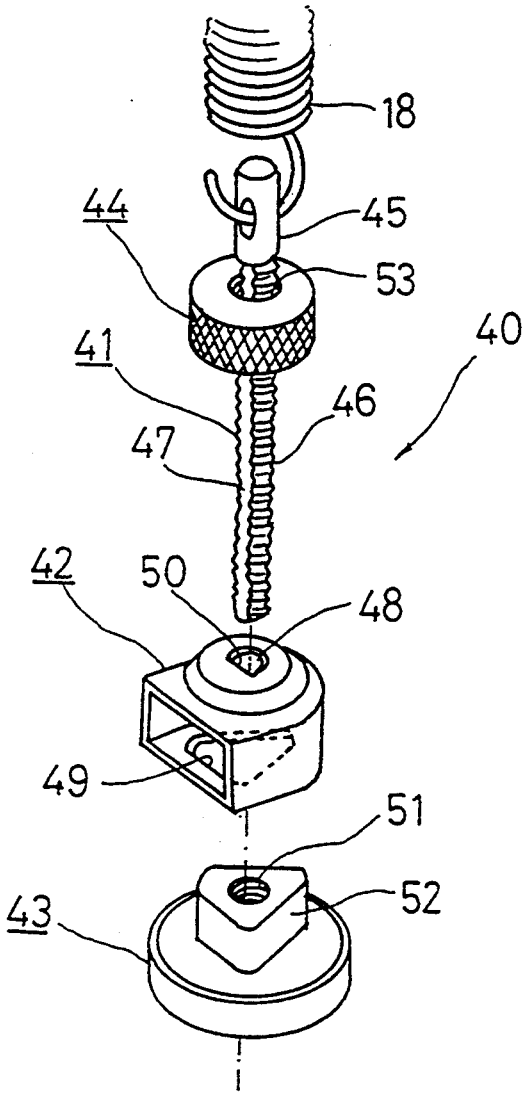
FIG. 5 is an exploded perspective view of the essential parts of the adjusting device.
Figure 6:
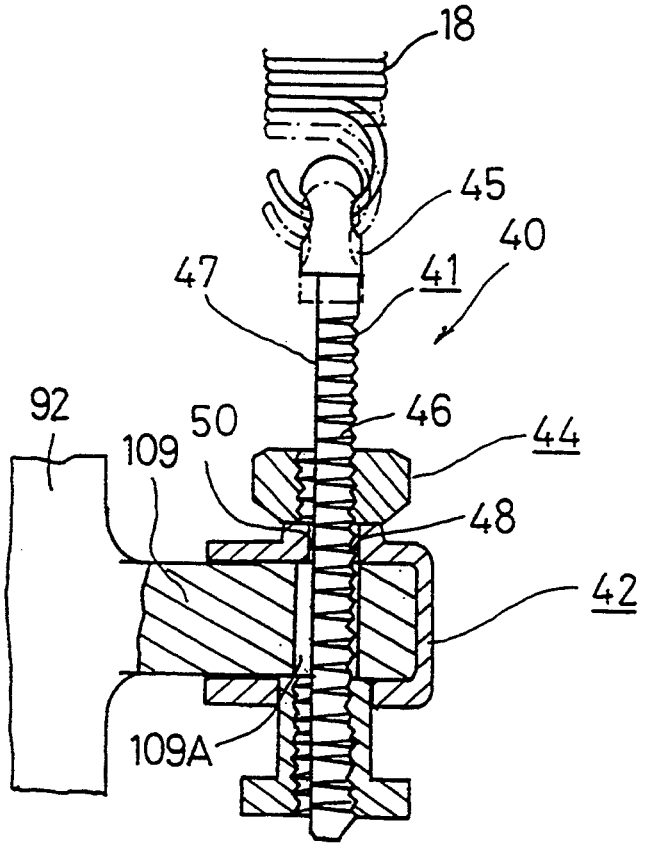
FIG. 6 is a cross section of the assembled adjusting device.

Referring to FIGS. 5 and 6, the adjusting device 40 comprises an adjustment screw 41, an installation part 42 for being nonmovably placed on the support 109, an adjustment nut 43 threaded on the screw 41 below the installation part 42 and a lock nut 44 also threaded on the screw 41 above the installation part 42. The adjustment screw 41 has a bar shape, is of a suitable length and has a screw thread 46 formed on its surface except that the adjusting screw 41 includes a planar surface 47 on one side without the screw thread 46 and extended in its longitudinal direction. The screw 41 includes a hanger part 45 to which the spring 18 is hung.

The adjustment nut 43 is screwed on the screw 41 from beneath the installation part 42. The position of the screw is fixed through the lock nut 44 which is tightened down onto the installation part 42.

The installation part 42 prevents any change in the resistance or load or tension of the spring 18 caused by the spring 41 rotating at the time of spring tension adjustment and prevents the direction or orientation of the spring 17 which was established at installation from being changed via its hanging part 45. The installation part 42 is installed on the lower bracket 109 of the support 92 and is stationary there. The part 42 includes a vertical insertion hole 48 in its top side for receiving the adjusting screw 41. The part 42 also includes a cut window 49 in its underside that is shaped the same as and is to be engaged with the protuberant part 52 atop the adjusting nut 43.

The insertion hole has the profile of the screw 41 and includes an engagement part which is provided in the insertion hole 48. That engagement part engages with the planar part 47 of the adjusting screw 41 so that the adjusting screw 41 which has been passed into the insertion hole 48 may not rotate as the nut 43 is rotated.

The adjustment nut 43 is screwed onto the lower part of the adjusting screw 41. A protuberant top part 52 is provided around the screw hole of the adjusting nut 43. The part 52 is to be engaged with the cut window 49 at the bottom of the installation part 42. Once the protuberant part 52 is engaged with the cut window 49, rotation, and particularly loosening, of the adjustment nut 43 is prevented and rotation of and therefore change in the tension of the spring 18 is prevented.

A lock nut 44 is positioned on the adjusting screw 41 as the screw is inserted through the upper surface of the installation part 42. The lock nut 44 has a hole 53 into which the adjusting screw 41 is inserted. The lock nut 44 is threaded to the screw threaded part of the adjusting screw 41 as the screw is screwed into the installation part 42.

To operate the adjusting device shown in FIG. 6, the lock nut 44 is loosened and lifted in the direction of the spring 18 which enables the screw 41 and the attached adjustment nut 43 to be lowered. Then the adjustment nut 43 is lowered along with the adjusting screw 41 to remove the protuberant part 52 of the nut from the cut window 49 of the installation part 42. The adjustment nut 43 then become freely rotatable.

As the adjustment nut 43 is rotated, the length of the adjusting screw 41 that is formed between the lower end of the spring and the lower bracket 109 is changed. This adjustment is carried out until a suitable spring tension is obtained.

Once adjustment of the tension on the spring 18 is completed, the protuberant part 52 of the adjustment nut 43 is again engaged with the cut window 49 of the installation part 42 which fixes it such that the adjustment nut 43 may not again rotate. The lock nut 44 is screwed down along the adjusting screw 41 against the upper side of the installation part 42, thereby holding the relative positions of the parts 41, 42, 43 and 44. In FIG. 6 there is a through hole 109A for the adjusting screw 41 formed in the lower bracket 109.

With this structure, the adjusting screw 41 can hardly rotate as it is maintained at a location where the least amount of resistance is given to the spring 18. Because of this, loosening of the adjustment nut 43 is prevented and the adjusting screw 41 is prevented from becoming shaky. As the tension of the spring 18 is not affected, further, it becomes possible to return the beater to its position off the drum head at a constant tension at all times.

The spring adjusting mechanism for the drum pedal herein does not give any extra load or resistance to the spring at the time of a spring tension adjustment and prevents any loosening of the adjusting screw, so that it does not affect the tensile strength of the spring, thereby maintaining the desired return speed of the beater.

Since a roller bearing is provided between the roller installation member and the cam, moreover, the roller installation member can be easily rotated irrespective of the tension on the spring. The bearing in the cam enables the easy installation or disengagement of a hanging ring. Further, the drum pedal can be folded and stored, making it possible for it to be conveniently transported.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A spring adjustment mechanism for a drum pedal, comprising:

a support; a beater rotary shaft supported on the support and rotatable around the axis of the shaft;

a drum beater connected to the shaft to be swung toward and away from a drum as the shaft is rotated; an operating member on the shaft, a foot operating pedal connected with the operating member so that movement of the pedal moves the operating member to rotate the shaft for swinging the drum beater toward and away from a drum head of a drum as the shaft is selectively rotated in opposite directions;

a cam supported on the shaft for rotation therewith, the cam including a hanger part spaced away from the shaft;

a spring hooked to the hanger part of the cam, the spring tension returning the cam to the position of least spring tension, for rotating the cam and the attached beater shaft and the attached beater to move away from the drum;

the hanger part of the cam being mounted freely rotatably to the cam, such that as the cam swings together with the shaft, the hanger part freely rotates with respect to the cam;

an adjustment screw for adjusting the tension of the spring, the screw being spaced away from the hanger part of the cam, the spring being hooked to the adjustment screw, the adjustment screw being movable with respect to the support and the hanger part for adjusting the tension of the spring, and means for fixing the screw at a selected adjusted position relative to the support; the fixing means comprising an installation part on the support having an insertion hole for receiving the adjustment screw, the adjustment screw and the installation part insertion hole being respectively so shaped that the adjustment screw is prevented from rotation by the insertion hole.

2. The adjusting mechanism of claim 1, further comprising a roller bearing supporting the hanger part of the cam and for causing the hanger part to be freely rotatable with respect to the cam.

3. The adjusting mechanism of claim 1, wherein the fixing means further comprises an adjustment nut threadedly received on the adjustment screw, the nut being engageable with the installation part for fixing the nut against rotation on the screw, and rotation of the adjustment nut with reference to the adjustment screw selectively positions the adjustment screw with reference to the hanger part for adjusting the tension on the spring.

4. The adjusting mechanism of claim 3, wherein the fixing means further comprises the adjustment screw having one side with a generally planar surface and the insertion hole in the installation part being correspondingly so shaped as to prevent rotation of the adjustment screw with respect to the installation part.

5. The adjusting mechanism of claim 4, wherein the fixing means further comprises the installation part having an underside facing toward the adjustment nut and the adjustment nut being at the underside of the installation part, the installation part having an installation window therein, the adjustment nut having a protuberant part thereof for engagement in the installation window of the installation part, and upon such engagement, the adjustment nut being thereafter prevented from rotating with respect to the installation part and the adjustment screw.

6. The adjusting mechanism of claim 5, further comprising a lock nut on the adjustment screw above the installation part on the side thereof away from the adjustment nut, the lock nut being tightenable toward the installation part and the adjustment nut for moving the protuberant part of the adjustment nut into the installation window for preventing rotation of the adjustment nut with respect to the installation part.

7. The adjusting mechanism of claim 3, further comprising selectively engageable cooperating means on the adjustment nut and the installation part such that upon engagement of the cooperating means, the adjustment nut is prevented from rotating with reference to the adjustment screw and the installation part by the cooperating means, while with the cooperating means disengaged, the adjustment nut is rotatable.

8. The adjusting mechanism of claim 7, further comprising locking means on the adjustment screw movable for selectively causing engagement of the cooperating means and permitting disengagement thereof.

9. The adjusting mechanism of claim 8, wherein the locking means comprises a lock nut on the adjustment screw above the installation part on the side thereof away from the adjustment nut, the lock nut being tightenable toward the installation part and the adjustment nut for moving the cooperating means into engagement.

10. The adjusting mechanism of claim 9, further comprising a roller bearing at and for the hanger part of the cam for causing the hanger part to be freely rotatable with respect to the cam.

11. The adjusting mechanism of claim 3, wherein the fixing means further comprises the installation part having an underside facing toward the adjustment nut and the adjustment nut being at the underside of the installation part, the installation part having an installation window therein, the adjustment nut having a protuberant part thereof for engagement in the installation window of the installation part, and upon such engagement, the adjustment nut being thereafter prevented from rotating with respect to the installation part and the adjustment screw.

12. The adjusting mechanism of claim 11, further comprising a lock nut on the adjustment screw above the installation part on the side thereof away from the adjustment nut, the lock nut being tightenable toward the installation part and the adjustment nut for moving the protuberant part of the adjustment nut into the installation window for preventing rotation of the adjustment nut with respect to the installation part.

* * * * *